US009353517B2

(12) United States Patent
Sade

(10) Patent No.: US 9,353,517 B2
(45) **Date of Patent: *May 31, 2016**

(54) EXTERNAL WALL AND ROOF SYSTEMS

(71) Applicant: Rovshan Sade, Raleigh, NC (US)

(72) Inventor: Rovshan Sade, Raleigh, NC (US)

(73) Assignee: Rovshan Sade, Raleigh, NC (US)

( * ) Notice: Subject to any disclaimer, the term of this patent is extended or adjusted under 35 U.S.C. 154(b) by 101 days.

This patent is subject to a terminal disclaimer.

(21) Appl. No.: 14/094,014

(22) Filed: Dec. 2, 2013

(65) Prior Publication Data

US 2014/0083032 A1 Mar. 27, 2014

Related U.S. Application Data

(63) Continuation of application No. 11/364,955, filed on Mar. 1, 2006, now Pat. No. 8,621,799.

(51) Int. Cl.

| | |
|---|---|
| ***E04B 1/26*** | (2006.01) |
| ***E04B 1/62*** | (2006.01) |
| ***E04B 1/70*** | (2006.01) |
| ***E04B 1/76*** | (2006.01) |
| ***E04B 2/70*** | (2006.01) |
| ***E04D 13/16*** | (2006.01) |
| ***E04D 13/17*** | (2006.01) |
| ***E04F 13/00*** | (2006.01) |

(52) U.S. Cl.

CPC ..... *E04B 1/7076* (2013.01); *E04B 1/26* (2013.01); *E04B 1/625* (2013.01); *E04B 1/7645* (2013.01); *E04B 1/7675* (2013.01); *E04B 2/707* (2013.01); *E04D 13/1625* (2013.01); *E04D 13/17* (2013.01); *E04D 13/172* (2013.01); *E04F 13/007* (2013.01)

(58) Field of Classification Search

CPC ..... E04B 1/26; E04B 1/625; E04B 1/665; E04B 1/7069; E04B 1/7076; E04B 1/7645; E04B 1/7654; E04B 1/7675; E04B 7/024; E04F 13/007

See application file for complete search history.

(56) References Cited

U.S. PATENT DOCUMENTS

| | | | | | |
|---|---|---|---|---|---|
| 2,264,961 | A * | 12/1941 | Ward | E04B 1/767 | 52/302.3 |
| 5,383,314 | A * | 1/1995 | Rothberg | E02D 31/02 | 405/43 |
| 5,497,596 | A * | 3/1996 | Zatkulak | E04B 1/70 | 52/408 |
| 5,596,847 | A * | 1/1997 | Stephenson | E04D 13/172 | 52/198 |
| 5,826,388 | A * | 10/1998 | Irving | E04B 1/7612 | 52/267 |
| 5,979,131 | A * | 11/1999 | Remmele | E04B 1/762 | 156/306.6 |
| 6,279,284 | B1 * | 8/2001 | Moras | E04B 1/10 | 52/105 |
| 6,355,333 | B1 * | 3/2002 | Waggoner | E04B 1/62 | 428/174 |
| 6,410,118 | B1 * | 6/2002 | Reicherts | B32B 13/04 | 428/141 |
| 6,745,531 | B1 * | 6/2004 | Egan | E04B 1/70 | 52/302.1 |

(Continued)

*Primary Examiner* — Ryan Kwiecinski

(74) *Attorney, Agent, or Firm* — Coats & Bennett, PLLC

(57) ABSTRACT

A ventilated exterior wall or roof system comprises frame including a plurality of frame members, and a double envelope structure attached to the exterior of the frame. The double envelope structure comprises a water resistant membrane, an exterior sheathing material disposed on the exterior side of and spaced from the water resistant membrane, and one or more air channels between the water resistant membrane and the exterior sheathing.

9 Claims, 3 Drawing Sheets

(56) References Cited

U.S. PATENT DOCUMENTS 6,804,922 B1 * 10/2004 Egan ..... B32B 5/02 52/309.1
6,938,383 B2 * 9/2005 Morris ..... E04B 1/26 52/198
6,990,775 B2 * 1/2006 Koester ..... E04B 1/70 428/121
7,367,165 B2 * 5/2008 Hatzinikolas ..... E04B 1/7046 52/302.1
2002/0108333 A1 * 8/2002 Clayton ..... E04B 1/70 52/302.1
2005/0102922 A1 * 5/2005 Williams ..... E40D 12/00 52/95
2006/0174573 A1 * 8/2006 Melencion ..... E04B 1/72 52/506.01
2006/0277854 A1 * 12/2006 Egan ..... E04B 1/70 52/302.3
2008/0034690 A1 * 2/2008 Gartz ..... E04B 1/70 52/302.3
2008/0104918 A1 * 5/2008 Gleeson ..... E04B 1/74 52/489.1
2010/0071292 A1 * 3/2010 Futterman ..... E04F 13/02 52/412
2010/0107533 A1 * 5/2010 Stephan ..... E04F 13/045 52/342

* cited by examiner

EXTERNAL WALL AND ROOF SYSTEMS

RELATED APPLICATIONS

This application is a continuation of U.S. patent application Ser. No. 11/364,955 filed Mar. 1, 2006, which is hereby incorporated herein by reference in its entirety.

BACKGROUND

In conventional frame construction, the framing for the exterior walls and roofs are covered with a sheathing material, such as plywood or oriented strand board (OSB). A finish siding or roofing material is applied over the sheathing material. A common problem with this type of construction is the infiltration of water through the finish siding of roofing material into the wall structure or roof structure. Accumulation of moisture within the structure can have adverse effects on the structure. Water may cause materials to warp and swell, promote growth of mildew and mold, and cause wood to degenerate and rot. Growth of molds can have serious health consequences and the development of rot can compromise the integrity of the building structure.

To prevent water damage, it is common practice to use a water barrier to prevent infiltration of moisture into exterior sheathing materials. Materials commonly used for moisture protection include asphalt impregnated felts and spunbonded polyolefin sheeting, e.g., Tyvek. Asphalt-impregnated felt material may become saturated when exposed to water for prolonged periods. Polyolefin materials, on the other hand, are designed to pass water vapor while preventing the passage of bulk water. Without air circulation, however, condensed water may be trapped between the polyolefin material and sheathing. Consequently, conventional building materials and construction methods may not be adequate in some circumstances to allow sheathing materials to fully dry out.

SUMMARY

The present invention relates to an exterior wall or roof system that allows for air circulation to keep building materials dry. The wall or roof system comprises a frame including a plurality of spaced-apart frame members. A breathable membrane is applied to the exterior side of the frame. The breathable membrane allows transmission of water vapor through the membrane buts prevents passage of bulk water. A plurality of spacers are secured to the frame members with the membrane in between. A sheathing material or decking material is secured to the spacers so as to define one or more enclosed air channels between the breathable membrane and the sheathing material. The air channels may be vented to the outside. An exterior finish material, such as a roofing material or finish siding, is applied over the sheathing material. In some applications, the finish material can be applied directly over the spacers without sheathing material. For example, roofing materials such as slate, tile and metal, may be applied over the spacers without a sheathing material The air circulation behind the sheathing material has several beneficial effects. First, the air circulation helps remove water that penetrates through the finish siding into the sheathing material. Secondly, the air circulation draws water vapor through the breathable membrane to keep insulation within the walls and roof of the structure dry. By keeping the insulation dry, the insulation is better able to prevent heat transfer, which can result in significant energy savings.

BRIEF DESCRIPTION OF THE DRAWINGS

FIG. 4 is a section view of a wall system without a sheathing material.

FIG. 5 is a perspective view of a roof system according to one embodiment of the invention without a breathable membrane.

DETAILED DESCRIPTION

Figure 1:
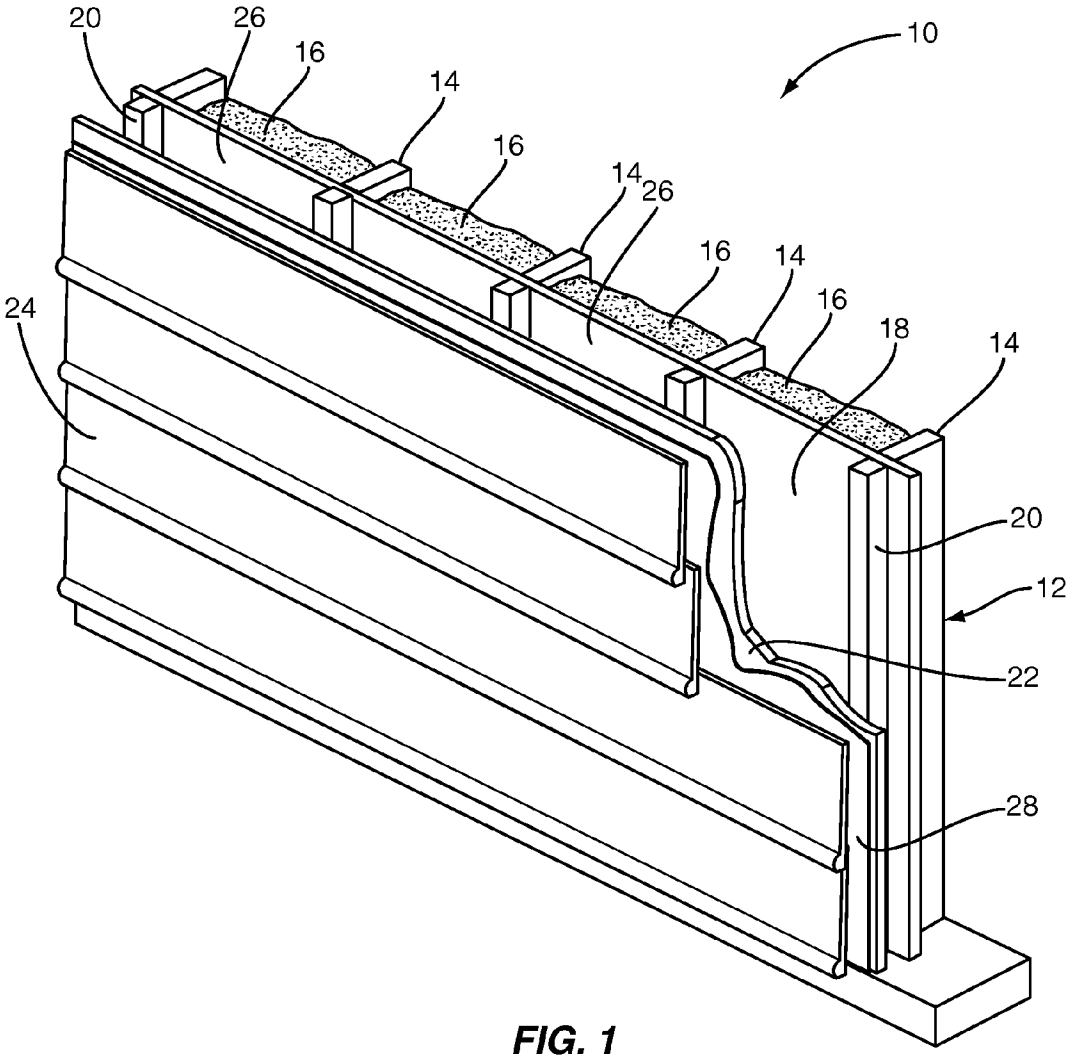
FIG. 1 is a perspective view of a wall system according to one embodiment of the invention.

FIG. 1 illustrates an exterior wall for a building structure. The exterior wall 10 comprises a frame 12, including a plurality of frame members or studs 14. An insulating material 16, such as fiberglass insulation, may be disposed between the frame members 14 to insulate the building structure. A breathable membrane 18, such as TYVEK house wrap or STAMOID water barrier, is applied to the exterior side of the frame 12. Breathable membranes 18 of this type allow water vapor to pass through but prevent passage of bulk water. Spacers 20, such as furring strips, are secured to the frame members 14 with the breathable membrane 18 sandwiched between them. A sheathing material 22, such as plywood, oriented strand board (OSB), or particle board, is secured to the spacers 20 and a finish siding 24 is applied over the sheathing material. The finish siding 24 may comprise horizontal siding, shingles, brick, stone, or stucco. In some applications, a second water barrier 28 may be disposed between the sheathing material and the finish siding. In some applications, the finish siding may be applied directly to the spacers 20 without an underlying sheathing layer. For example, horizontal siding can be secured directly to the spacers 20.

Figure 2:
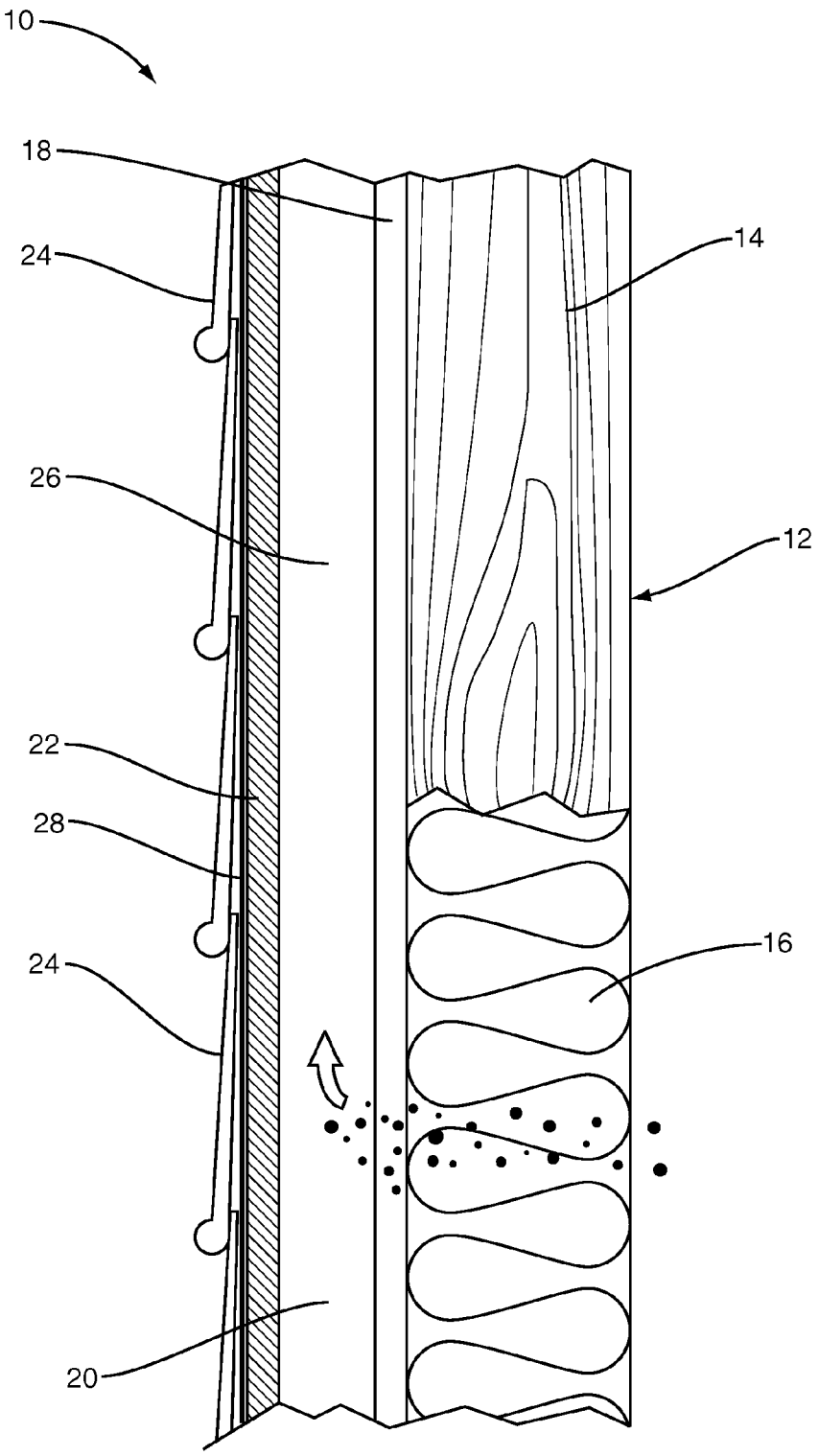
FIG. 2 is a section view of the wall system.

As shown in FIG. 2, the wall system 10 includes a plurality of air channels 26 between the vertically-oriented spacers 20. The air channels 26 may be vented at the top and bottom to facilitate air flow between the breathable membrane 18 and sheathing material 22. However, those skilled in the art will appreciate that normal leakage of air in typical frame construction may be sufficient to provide air circulation without ventilation. The air flow within the air channels 26 helps remove moisture from the sheathing material 22 that infiltrates past the finish siding 24. In addition, the air flow helps draw water vapor from the interior of the frame 12, through the breathable membrane 18 and into the air channel 26 to keep the insulation 16 dry. Heat generated by sunlight during the daytime causes condensed water in the insulation 16 to change to water vapor. The water vapor may then pass through the breathable membrane 18 into the air channel 26 and carried away. This process of evaporation and transmission of water through the breathable membrane 18 keeps the insulation dry.

Figure 3:
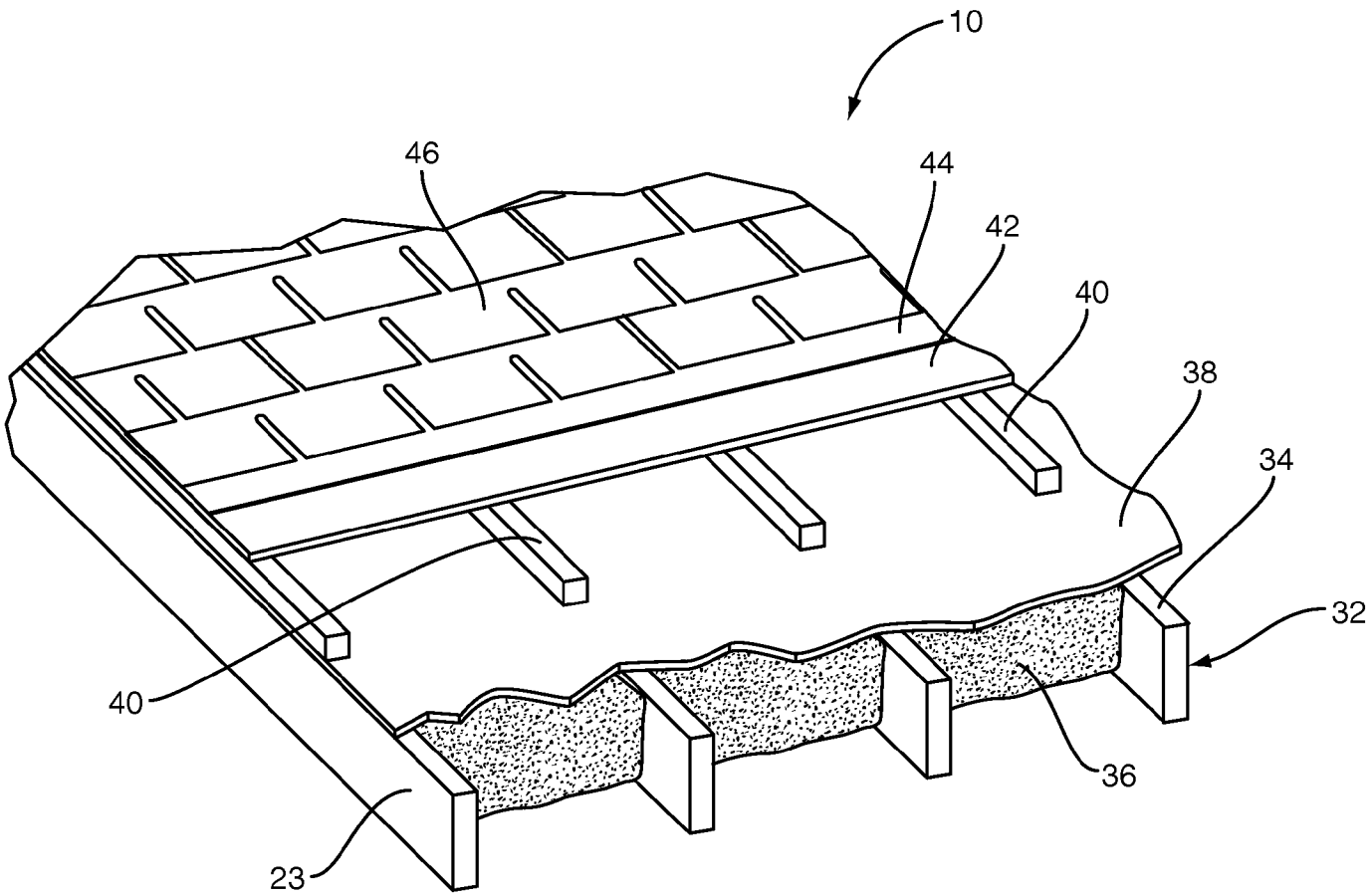
FIG. 3 is a perspective view of a roof system according to one embodiment of the invention.

FIG. 3 illustrates a roof system according to another embodiment of the invention. The roof system comprises a frame 32 including a plurality of frame members or rafters 34. An insulating material 36, such as fiberglass insulation, may be disposed between the frame members 34 to insulate the roof. A breathable membrane 38 is disposed on the exterior side of the frame members 34. Spacers 40 are secured to the frame members 34 with the breathable membrane sandwiched in between. A sheathing material 42, also referred to as decking material, is secured to the spacers 20. A water barrier 44, such as asphalt impregnated felt material, may be applied over the sheathing material 42 and then covered with a roofing material 46, such as a metal roofing or shingles. In some applications, the roofing material may be applied directly to the spacers 40 without an underlying sheathing layer or decking. For example, roofing material such as slate, tile and metal roofing can be secured directly to the spacers 40.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A ventilated exterior wall or roof system comprising:

a frame including a plurality of frame members;

a water resistant membrane disposed on an exterior side of the frame, said water resistant membrane comprising a breathable membrane that passes water vapor while preventing passage of bulk water;

an exterior sheathing spaced from an exterior side of said water resistant membrane said sheathing comprising one of plywood, oriented strand board (OSB), and particle board;

one or more air channels between said water resistant membrane and said exterior sheathing; and an exterior finish applied to an exterior side of the exterior sheathing.

2. The ventilated exterior wall or roof system of claim 1 wherein said water resistant membrane comprises a breathable membrane that passes water vapor while preventing passage of bulk water.

3. The ventilated exterior wall or roof system of claim 1 wherein the exterior finish comprises a finish siding applied to an exterior side of said exterior sheathing.

4. The ventilated exterior wall or roof system of claim 3 wherein said finish siding comprises one of horizontal siding, shingles, brick, stone, or stucco.

5. The ventilated exterior wall or roof system of claim 3 further comprising a second water resistant membrane between said exterior sheathing and said finish siding.

6. The ventilated exterior wall or roof system of claim 1 wherein the exterior finish comprises a roofing material applied to an exterior side of said exterior sheathing.

7. The ventilated exterior wall or roof system of claim 6 wherein said roofing material comprises one of a metal roofing, slate, or shingles.

8. The ventilated exterior wall or roof system of claim 6 further comprising a second water resistant membrane between said exterior sheathing and said roofing material.

9. The ventilated exterior wall or roof system of claim 1 further comprising insulation applied to the frame and disposed on an interior side of the water resistant membrane.

* * * * *